US006848343B2

(12) United States Patent
Wu

(10) Patent No.: US 6,848,343 B2
(45) Date of Patent: Feb. 1, 2005

(54) WRENCH CAPABLE OF STABILIZING FASTENER

(76) Inventor: Arthur Wu, No. 22, Alley 28, Lane 360, Chung Shan Rd., She Kou Village, Shen Kang Hsiang, Taichung Hsien (TW)

( * ) Notice: Subject to any disclaimer, the term of this patent is extended or adjusted under 35 U.S.C. 154(b) by 0 days.

(21) Appl. No.: 10/351,327

(22) Filed: Jan. 27, 2003

(65) Prior Publication Data

US 2004/0123702 A1 Jul. 1, 2004

(51) Int. Cl.[7] ..... B25B 13/16
(52) U.S. Cl. ..... 81/170; 81/186; 81/179
(58) Field of Search ..... 81/13, 125, 129, 81/129.5, 131–176, 179, 176.1, 176.2, 176.3, 186

(56) References Cited

U.S. PATENT DOCUMENTS 2,731,866 A * 1/1956 Erickson ..... 81/186
2,846,912 A * 8/1958 Day ..... 81/179
3,079,820 A * 3/1963 Vantchoura ..... 81/179
4,437,364 A * 3/1984 Martinmaas ..... 81/179
4,706,528 A * 11/1987 Inoue ..... 81/179
4,823,652 A * 4/1989 Morrissey et al. ..... 81/125
4,889,020 A * 12/1989 Baker ..... 81/119
5,351,585 A * 10/1994 Leseberg et al. ..... 81/426
5,533,428 A * 7/1996 Pradelski ..... 81/179
5,582,082 A * 12/1996 Gajo ..... 81/111
6,089,131 A * 7/2000 Taimiot ..... 81/186
6,202,516 B1 * 3/2001 Kim ..... 81/179
6,276,240 B1 * 8/2001 Blacklock ..... 81/119

FOREIGN PATENT DOCUMENTS

JP 04025382 A * 1/1992 ..... B25B/23/10

* cited by examiner

*Primary Examiner*—David B. Thomas
(74) *Attorney, Agent, or Firm*—Bacon & Thomas

(57) ABSTRACT

An adjustable wrench. When the wrench is turned in a direction, the fastener is turned and when the wrench is turned in an opposite direction, the fastener is kept still. The wrench includes a handle having a fixed jaw, a movable jaw slidably provided on the handle, an adjusting worm for driving the movable jaw moving and an elastic supporting device. The fixed jaw has a holding surface facing the movable jaw, the holding surface has a driving face and a base face with one end connecting the rails and another end connecting the driving face. The base face rests against a fixed side of the fastener and the driving face rests against a movable side of the fastener which is a side next to the fixed side. The movable jaw has a holding surface facing the fixed jaw. The holding surface has a driven face that rests against a third side of the fastener which is a side opposite from the movable side, and an elastic supporting device has one end provided on the holding surface of the movable jaw to be elastically movable against the fastener.

10 Claims, 4 Drawing Sheets

WRENCH CAPABLE OF STABILIZING FASTENER

BACKGROUND OF THE INVENTION

1. Field of the Invention

The present invention relates generally to a hand tool, and more particularly to an apparatus of a wrench is capable of stabilizing a fastener, such as a bolt or a nut, held by the wrench.

2. Description of the Related Art

A conventional open-end wrench or close-end wrench or adjustable wrench turns a nut (or a bolt) an angle, it must move the wrench away the nut, and then turn the wrench reversely and re-engage the nut again for the next turn. Repeat the aforesaid steps, one can tighten or loose the nut.

There was a kind of wrench which can turn a nut (or a bolt) repeatedly without having to move the wrench away the nut. Such wrench is called "speed wrench" or "reversible wrench".

A conventional speed wrench has two jaws with a holding surface having specific shape to hold a nut therebetween so that when turns the wrench forwards can drive the nut turning, but when turns the wrench backwards can keep the nut still.

There also were some adjustable wrenches having function of speed wrench. But an adjustable wrench can turn nuts of specific sizes so that a fixed jaw and a movable jaw touch the nuts with different sizes with their different position. Therefore, simply apply specific shapes of the fixed jaw and the movable jaw may not work.

FIG. 8 shows a conventional adjustable wrench 3, which provides a positioner member 92 at a proximal end of a fixed jaw 91. The positioner member 92 can be driven to move simultaneously by a movable jaw 93. The position member 92 will support a nut (or a bolt) held by the fixed jaw 91 and the movable jaw 93 to make the nut positioning at a specific position no matter what sizes of the nuts. The positioner member, however, has a complex structure, it rises the cost, and more particularly, dust might run into the positioner member and make it not function.

SUMMARY OF THE INVENTION

The primary objective of the present invention is to provide a wrench, which is capable of stabilizing a fastener, such as a nut or a bolt, held by the wrench and turning the fastener repeatedly without having to move the wrench away the fastener.

According to the objectives of the present invention, a wrench, when the wrench is turned in a direction, the fastener is turned and when the wrench is turned in opposite direction, the fastener is kept still, comprises a handle having a head portion at an end thereof, a first jaw and a second jaw at a distal end of the head portion. The first jaw has a holding surface facing the second jaw, wherein the holding surface has a driving face and a base face with an end thereof connecting the rails and the other end thereof connecting the driving face, wherein the base face is to rest against a first side of the fastener and the driving face is to rest against a second side of the fastener which is a side next to the first side. The second jaw has a holding surface facing the first jaw, wherein the holding surface has a driving face to rest against a third side of the fastener which is a side opposite from the second side, and an elastic supporting device has and end thereof provided on the holding surface of the second jaw to be elastically against the fastener.

DETAILED DESCRIPTION OF THE INVENTION

Figure 1:
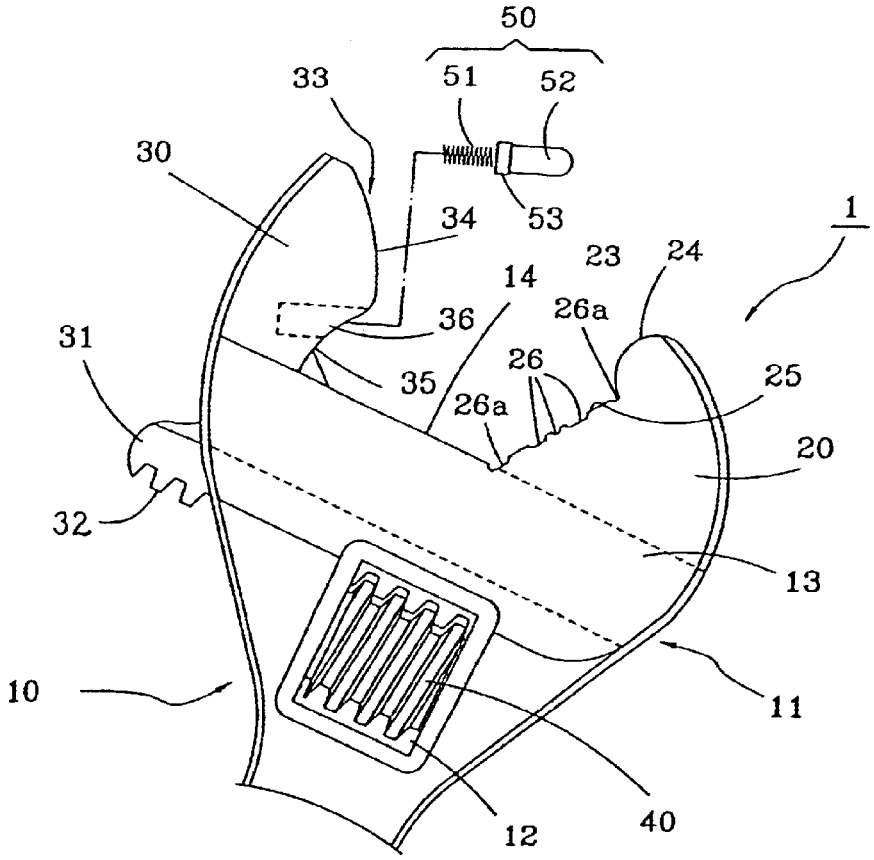
FIG. 1 is an exploded view of a first preferred embodiment of the present invention.
Figure 2:
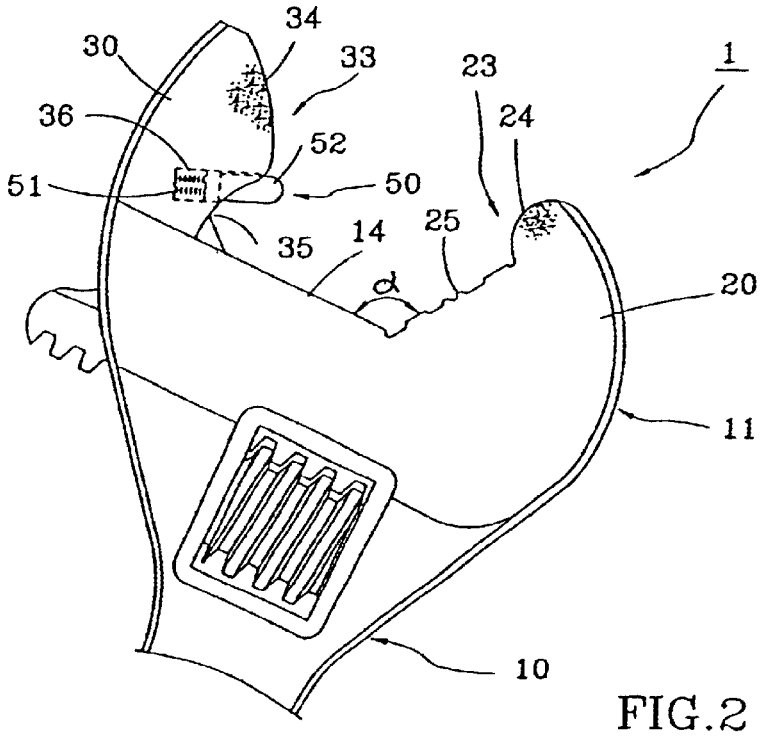
FIG. 2 is a front view of the first preferred embodiment of the present invention.
Figure 3:
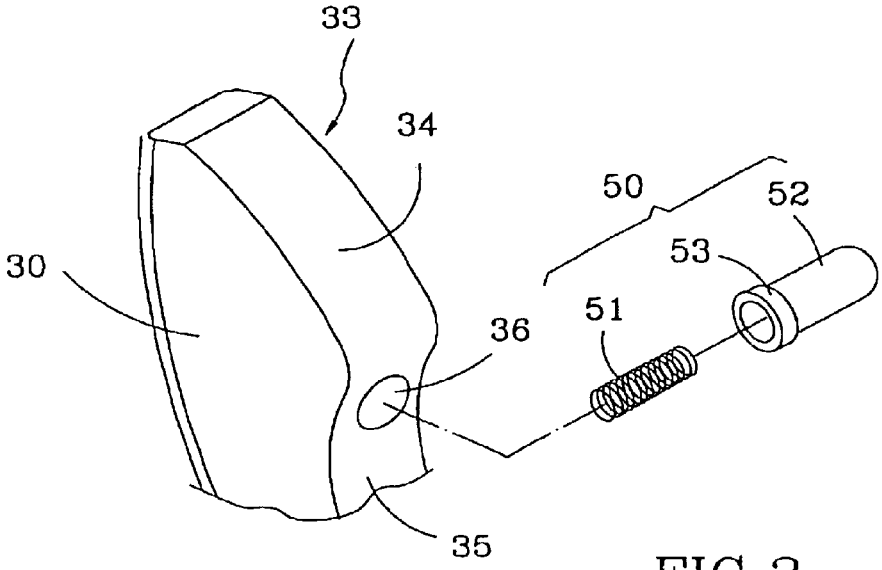
FIG. 3 is an exploded view in part of the first preferred embodiment of the present invention, showing an elastic supporting device being going to be mounted on a movable jaw.

Please refer to FIGS. from FIG. 1 to FIG. 3, an adjustable wrench of the first preferred embodiment of the present invention mainly comprises a handle 10 having a fixed jaw 20 at an end thereof, a movable jaw 30, an adjusting worm 40 and an elastic supporting device 50, wherein The handle 10 has a head portion 11 at the end having the fixed jaw 20 in which has a opening 12 and a guiding slot 13, wherein the opening 12 is communicated with the guiding slot 13 and the guiding slot 13 is opened at a distal end of the head portion beside the fixed jaw so that two rails 14 are defined at the distal end of the head portion 11 at opposite sides of the guiding slot 13. The rails 14 have ends connected to the fixed jaw 20 and the orientations of the rails 14 are parallel to the orientation of the guiding slot 13.

The movable jaw 30 has a rod portion 31 at a bottom thereof having a rack 32 thereon. The movable jaw 30 is slidably provided on the handle 10 with the rod portion 31 received in the guiding slot 13 so that the movable jaw 20 can move towards or away from the fixed jaw 20.

The adjusting worm 40 is arranged in the opening 12 and pivoted on the handle 10. The adjusting worm 40 is engaged with the rack 32 of the movable jaw 30 so that turn the adjusting worm 40 can drive the movable jaw 30 moving.

The fixed jaw has a holding surface 23 facing the movable jaw 30. The holding surface 23 has a convex driving face 24 at a distal side of the holding surface 23 and a base face 25 having an end connecting the driving face 23 and the other end connecting the rails 14. The base face 25 has recesses 26 thereon, one of which locates at the junction of the base face 25 and the driving face 24 and another one of which locates at the junction of the base face 25 and the rails 14, these two recesses are labeled as 26*a*.

There is an included angle a between the base face 25 of the fixed jaw 20 and the rails 14 in the range of 123–134 degrees.

The movable jaw 30, similarly, has a holding surface 33 facing the fixed jaw 20. The holding surface 33 has a convex driving face 34 at a distal side of the holding surface 33 and a concave face 35 at a proximal side and having an end thereof connecting the driving face 33. The concave face 35 is provided with a hole 36 thereon.

The elastic supporting device 50 consists of a spring 51 and a pin 52 installed in the hole 36 on the movable jaw 30 in sequence. The pin 52 has a distal end extruded out of the hole 36. The pin 52 has an annular flange 53 at a proximal end thereof and the diameter of an outer end of the hole is smaller than the outer diameter of the pin 52 so that the pin 52 can not escape from the hole 36. The flip spring 51 has an end thereof against the movable jaw 30 and the other end thereof against the pin 52.

Figure 5:
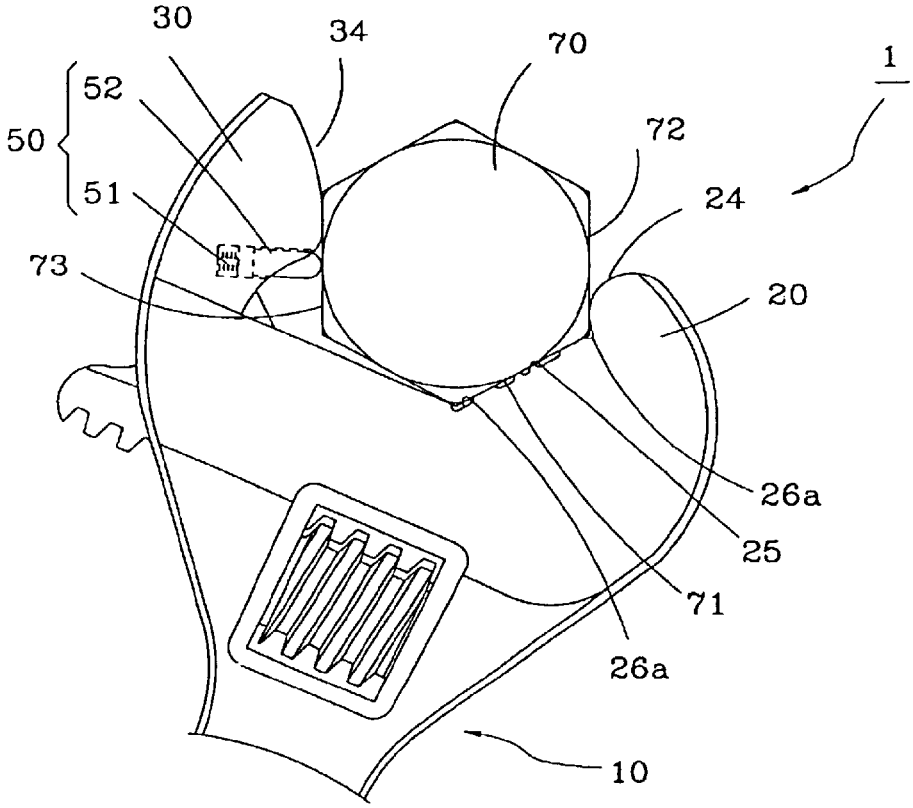
FIG. 5 is a front view of the first preferred embodiment of the present invention, showing the wrench holding a nut of larger size.

FIG. 5 shows the adjustable wrench of the first preferred embodiment of the present invention holding a nut 70 with the fixed jaw 20 and the movable jaw 30. The base face 25 of the fixed jaw 20 rests against a first side 71 of the nut 70, the driving face 24 rests against a second side 72, which is a side next to the first side 71, of the nut 70 and the driving face 34 of the fixed jaw 30 rests against a third side 73, which is a side opposite from the second side 72, of the nut 70. The bullet 52 of the elastic supporting device 50 is elastically against the third side 73 of the nut 70.

When the handle 10 is turned clockwise, it will drive the nut 70 turning and when the handle 10 is turned counterclockwise, it will keep the nut 70 still. Such that the adjustable wrench of the present invention can repeatedly drive the nut 70 turning without having to move the wrench away from the nut.

Figure 4:
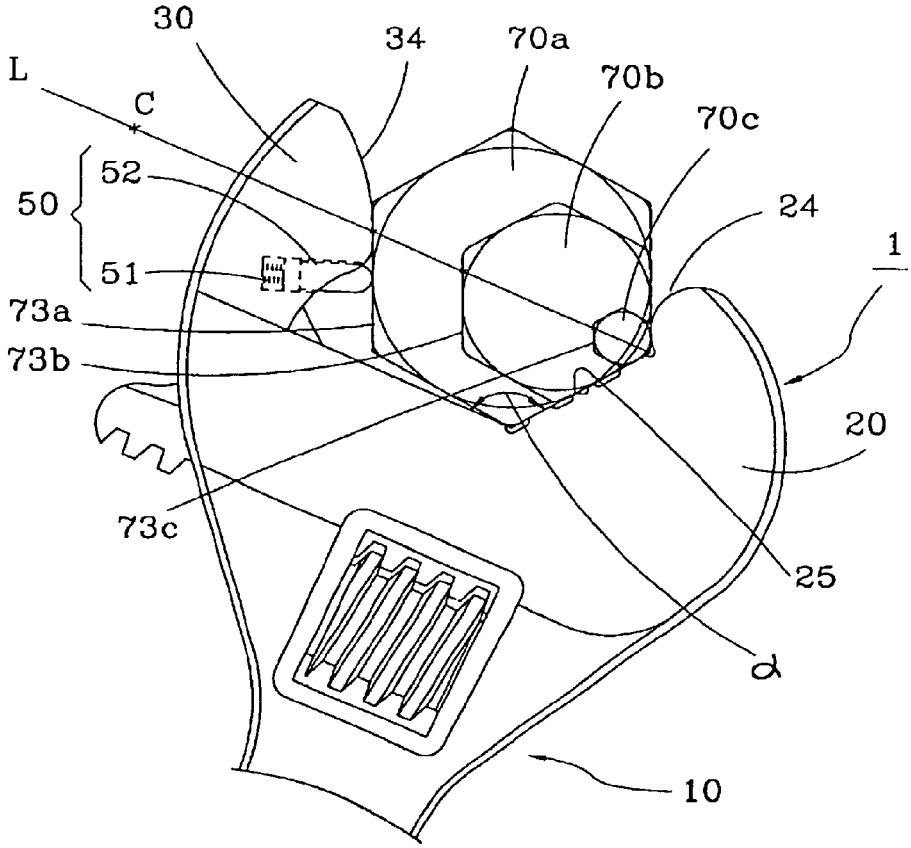
FIG. 4 is a front view of the first preferred embodiment of the present invention, showing the route of the movable jaw.

Because of the adjustable wrench of the present invention can turn nuts of different sizes in a predetermined range, FIG. 4 shows the adjustable wrench being able to hold three nuts 70*a*, 70*b* and 70*c* with different sizes. The pin 52 of the elastic supporting device 50 will be elastically pressed against the nuts 70*a*, 70*b* and 70*c*. A line L shows a point of the driving face 34 of the movable jaw 30 being against the third sides 73*a*, 73*b* and 73*c* of the nuts 70*a*, 70*b* and 70*c* with different sizes and the X signs show the positions of the third sides 73*a*, 73*b* and 73*c* touching the driving face 34 of the movable jaw 30. A center of curvature C of the driving face 34 of the movable jaw 30 is located at an extension of the line L so that the driving face 34 will touch the third side 73 of the nut 70 with a most protruding point thereof no matter what the size of the nut is.

The line L also can indicate the orientation of the movable jaw 30 moving so that the line L is parallel to the rails 14. I design the point of the driving face 24 of the fixed jaw 20 against the second side 72 of the nut 70 at a lower half thereof and the point of the driving face 34 of the movable jaw 30 against the third side 73 of the nut 70 at an upper half thereof so that it can provide larger power to turn the nut 70. So that, according to the limitation above, an included angle $\alpha$ between the base face 25 and the rail 14 is in a range of 123 degrees to 134 degrees.

The recesses 26 on the base face 25 of the fixed jaw 20 can prevent the base face 25 against two edges of the first side 71 of the nut 70 held by the adjustable wrench of the present invention to prevent the edges being worn. The recesses 26 are provided at specific positions of the base face 25 according to the sizes of nuts 70 which can be turned by the wrench. Two specific recesses 26*a* are provided at a junction of the base face 25 and the driving face 24 and the base face 25 and the rails 14 respectively.

The driving faces 24 and 34 of the fixed jaw 20 and movable jaw 30 each has a hardening layer (shown as dots region in FIG. 2) at regions of which against the nut. The hardening layer can be made from embedding hard metal or carburizing etc. The hardening layers can prevent the driving faces 24 and 34 of the fixed jaw 20 and movable jaw 30 from being damaged when turning the nut.

Figure 6:
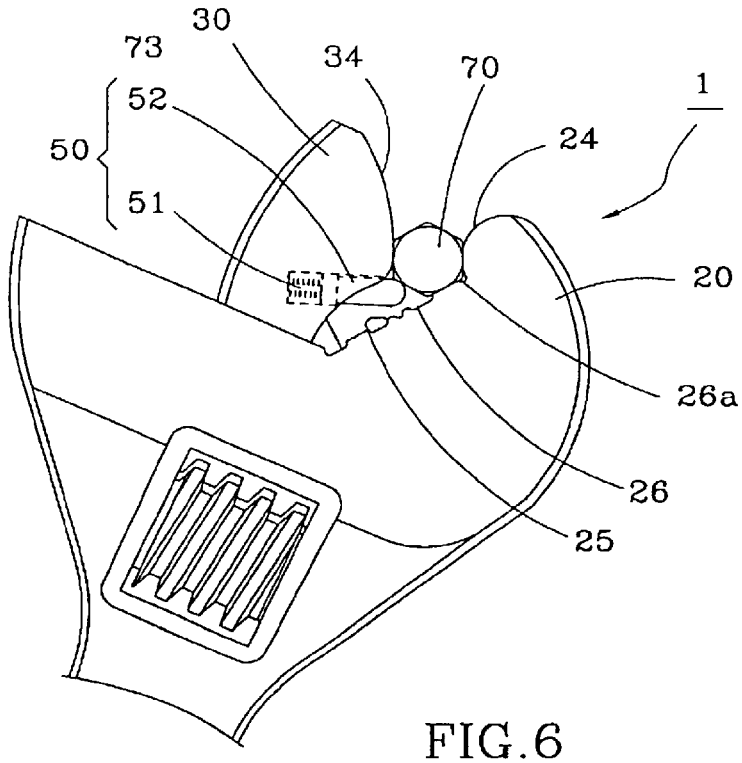
FIG. 6 is a front view of the first preferred embodiment of the present invention, showing the wrench holding a nut of smaller size.

The elastic supporting device 50 is elastically against the nut 70, no matter a larger nut 70 as shown in FIG. 5 or a smaller nut 70 as shown in FIG. 6. Because of the adjustable wrench of the present invention is reversible so that there is a space left between the fixed jaw 20 and movable jaw 30 to make the nut 70 can keep still when the wrench is turned reversibly. Without the elastic supporting device 50, the fixed jaw and movable jaw 30 can not hold the nut 70 stably. In the other words, with the elastic supporting device 50 against the nut 70, the fixed jaw 20 and movable jaw 30 and support the nut 70 at a predetermined position (no matter what size of the nut) such that the adjustable wrench of the present invention can turn the nut 70 repeatedly and stably.

Figure 7:
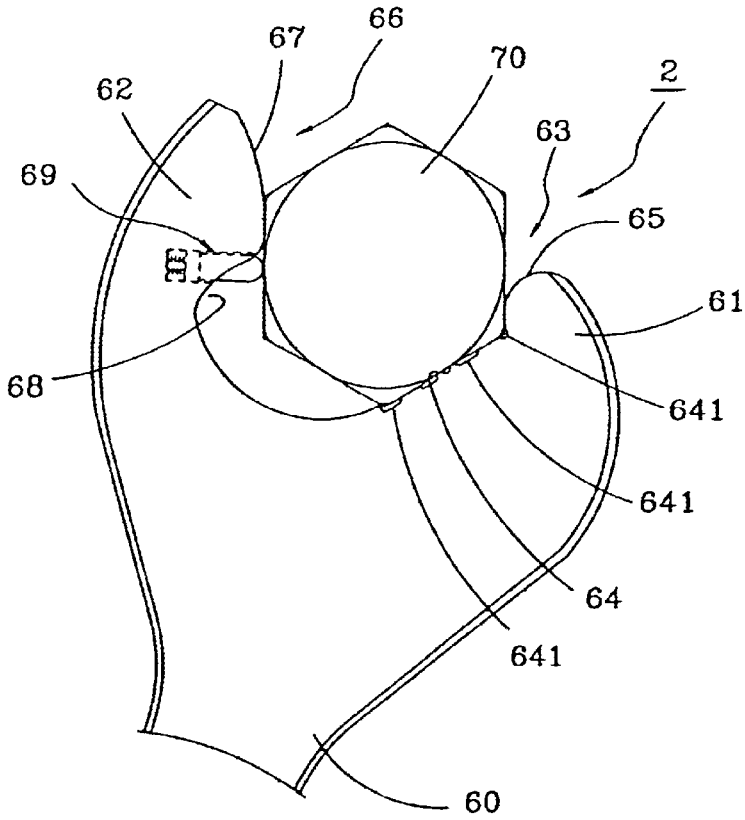
FIG. 7 is a front view of a second preferred embodiment of the present invention.
Figure 8:
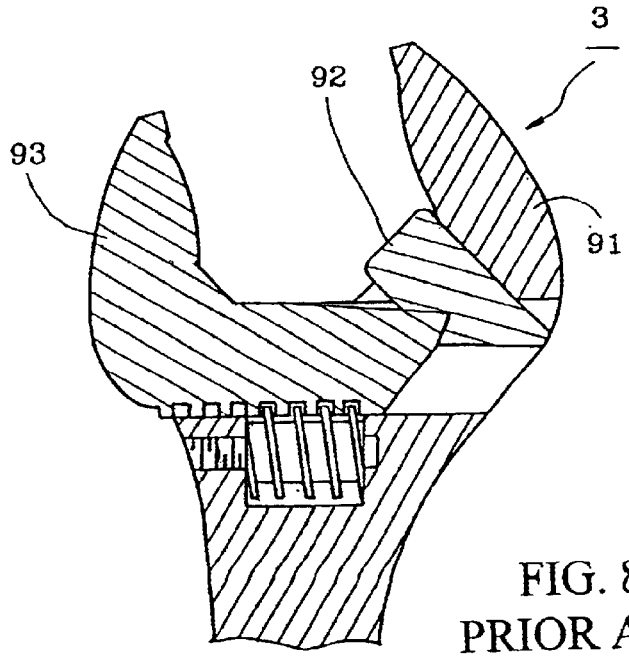
FIG. 8 PRIOR ART
FIG. 8 is a sectional view of a conventional adjustable wrench.

FIG. 7 shows of the second preferred embodiment of the present invention, which provides an open-end wrench 2. The wrench 2 comprises a handle 60 having a first jaw 61 and a second jaw 62 at an end thereof. The first wrench 61 has a holding surface 63 having a base face 64 and a driving face 65. The base face 64 has recesses 641 thereon. The second jaw 62 has a holding surface 66 having a driving face 67 and a concave face 68 thereon. An elastic supporting device 69 is installed on the concave face 68 to elastically support a nut held by the first and the second jaw 61 and 62. The function and characters of the wrench 2 of the second preferred embodiment are as same as the adjustable wrench 1 of the first preferred embodiment of the present invention, except that the wrench 2 of the second preferred embodiment only can turn nuts with a specific size.

What is claimed is:

1. An adjustable wrench, which can turn fasteners with different sizes, wherein when the wrench is turned in a direction, the fastener is turned and when the wrench is turned in opposite direction, the fastener is kept still, comprising:

a handle having a head portion at an end thereof, a guiding slot in said head portion, two rails at opposite sides of a top of said guiding slot, an opening communicated with said guiding slot and a fixed jaw at ends of said rails;

a movable jaw having an end thereof slidably received in said guiding slot of said handle;

an adjusting worm received in said opening and pivoted on said handle for driving said movable jaw to move;

said fixed jaw having a holding surface facing said movable jaw, wherein said holding surface has a driving face and a base face with an end thereof connecting said rails and the other end thereof connecting said driving face, wherein said base face is to rest against a first side of the fastener and said driving face is to rest against a second side of the fastener which is a side next to said first side;

said movable jaw having a holding surface facing said fixed jaw, wherein said holding surface has a driving face to rest against a third side of the fastener which is a side opposite from said second side;

an elastic supporting device having an end thereof provided on said holding surface of said movable jaw to be elastically movable against the fastener; and an included angle between said base face of said fixed jaw and said rails is in a range of 123 degrees to 134 degrees.

2. The adjustable wrench as defined in claim 1, wherein said driving face of said fixed jaw has a hardening layer thereon.

3. The adjustable wrench as defined in claim 1, wherein said driving face of said movable jaw has a hardening layer thereon.

4. The adjustable wrench as defined in claim 1, wherein said base face of said fixed jaw is provided with at least a recess thereon.

5. The adjustable wrench as defined in claim 1, wherein said fixed jaw is provided with a recess thereon at a junction between said base face and said rails.

6. The adjustable wrench as defined in claim 1, wherein said driving face of said movable jaw comprises convex surfaces and said driving face of said movable jaw is directed against said third side of said fastener.

7. The adjustable wrench as defined in claim 1, wherein said elastic supporting device has a spring and a pin and said holding surface of movable jaw is provided with a hole thereon and said spring and said pin are installed in said hole.

8. The adjustable wrench as defined in claim 7, wherein said pin has an annular flange and a diameter of a distal end of said hole is smaller than an outer diameter of said flange.

9. The adjustable wrench as defined in claim 1, wherein said holding surface of said movable jaw further has a concave face at a proximal side of said driving face.

10. The adjustable wrench as defined in claim 9, wherein said holding surface of said movable jaw provides a hole at said concave face to install said elastic device therein.

* * * * *